US005382499A

United States Patent [19]

Keelan et al.

[11] Patent Number: 5,382,499

[45] Date of Patent: Jan. 17, 1995

[54] COLOR REVERSAL PHOTOGRAPHIC ELEMENTS ADAPTED FOR UNDERWATER PHOTOGRAPHY

[75] Inventors: Brian W. Keelan, Rochester; Robert Niklewicz, Penfield; Diane P. Libby, Webster; John V. Nelson, Fairport, all of N.Y.

[73] Assignee: Eastman Kodak Company, Rochester, N.Y.

[21] Appl. No.: 114,523

[22] Filed: Aug. 31, 1993

Related U.S. Application Data

[63] Continuation-in-part of Ser. No. 920,077, Jul. 27, 1992, abandoned.

[51] Int. Cl.[6] ..... G03C 1/46

[52] U.S. Cl. ..... 430/503; 430/502; 430/506; 430/509; 430/379

[58] Field of Search ..... 430/503, 379, 502, 509, 430/504, 506

[56] References Cited

U.S. PATENT DOCUMENTS 3,752,670 8/1973 Needler et al. ..... 96/74
4,542,959 9/1985 Kreutzig ..... 350/311
4,582,780 4/1986 Giusto et al. ..... 430/505
4,653,883 3/1987 Maeno ..... 354/64
4,902,609 2/1990 Hahm ..... 430/504

*Primary Examiner*—Charles L. Bowers, Jr.
*Assistant Examiner*—Geraldine Letscher
*Attorney, Agent, or Firm*—Carl O. Thomas

[57] ABSTRACT

A photographic film is disclosed particularly adapted for underwater photography. The film is comprised of a film support, a blue recording layer unit capable of forming a yellow dye image, a green recording layer unit capable of forming a magenta dye image, and a red recording layer unit capable of forming a cyan dye image. At an exposure temperature of 5500° K. and an optical density of 0.8 above minimum density the red recording layer unit exhibits a speed that is (T/10) log E greater than that of the green recording layer unit, where E is exposure in lux-seconds and T is the light transmission distance in meters through water required to match the speed of the red recording layer unit to the speed of the green recording layer unit, T being in the range of from 1.5 to 15 meters.

11 Claims, No Drawings

COLOR REVERSAL PHOTOGRAPHIC ELEMENTS ADAPTED FOR UNDERWATER PHOTOGRAPHY

This is a continuation-in-part of U.S. Ser. No. 920,077, filed Jul. 27, 1992, now abandoned.

FIELD OF THE INVENTION

The invention relates to photographic elements. More specifically, the invention relates to photographic elements particularly adapted for underwater photography.

BACKGROUND

Although professional photographers have made available to the general public color pictures of underwater subjects of the most striking and appealing hues, extending over the full range of the visible spectrum, it is much more difficult to obtain pleasing color balances underwater than in photographing above-water subjects. While professional photographers in general prefer color reversal films to color negative films, obtaining pleasing color balances underwater with color reversal films is particularly difficult. In color reversal photography the image captured by the camera is directly viewed after photographic processing, whereas in color negative photography (i.e., negative working films that are printed on color paper) the opportunity exists to compensate for color imbalances in the printing step.

The color balance problem in underwater photography arises from the marked attenuation of red light transmitted through water. Within each 3 meters of light transmission in water approximately half of the red light is absorbed. This results in underwater scenes having a marked cyan cast, indicative of red light deficiency.

The cyan cast of distant underwater subjects is not objectionable, since we have become accustomed to this color balance for distant underwater subjects. This is how they are "supposed" to look. However, there are a large array of foreground subjects for underwater photography that exhibit brilliant colors. Photographs that portray these foreground subjects with a cyan cast that diminishes the brilliancy of the hues, particularly reds and yellows, are understandably judged by most viewers as decidedly inferior. For the professional photographer a picture of a subject with a cyan cast is frequently not marketable and for the amateur the same picture is often a disappointment.

Photographers have employed a variety of techniques for getting brilliant subject hues underwater. The simplest one is to work in shallow water, but with one half red light attenuation occurring in only 3 meters of transmission this is highly limiting. A subject immersed at a depth of 1.5 meters and at a distance from the underwater photographer of 1.5 meters exhibits a one stop (0.3 log E, where E is exposure in lux-seconds) deficiency in red exposure when photographed with a color film exhibiting a daylight (i.e., a 5500° K. color temperature) color balance.

Notice that half of the light transmission distance underwater in the example above is from the atmosphere to the subject and that the remainder of the transmission distance is from the subject to the camera. The photographer can improve the color balance of an underwater subject by moving closer to the subject, thereby reducing the light transmission distance underwater to little more than that required by the depth of the subject. This strategy, however, limits the photographer to approachable subjects. It requires little reflection to realize that successful underwater photography of elusive subjects is often frustrated by the limited light transmission distances that are compatible with capturing brilliant subject colors.

A conventional strategy for correcting color imbalances underwater is to employ one or a combination of camera lens filters. Needler et al U.S. Pat. No. 3,752,670 and Kreutzig U.S. Pat. No. 4,542,929 illustrate filters for underwater photography. Unfortunately, the basic problem is red light deficiency underwater and no lens filter can increase the amount of red light available. Lens filters instead capture blue and green light to bring the red, green and blue light closer to their desired balance. This has the effect of decreasing the light available for image capture and requires compensation by increasing the camera lens aperture and/or decreasing the camera shutter speed. Increasing the camera lens aperture reduces image sharpness and depth of field. Decreasing shutter speed reduces the opportunity for capturing sharp images of moving subjects and raises the risk of image unsharpness attributable to camera shake. The common technique of tripod exposure is considerably more difficult to implement underwater.

A common alternative is to synchronize camera exposure with a daylight (5500° K.) strobe. Maeno U.S. Pat. No. 4,653,883 illustrates an underwater camera and strobe combination. With strobe illumination the light attenuation distance is twice the distance to the subject and independent of the depth, since the light travels from the strobe to the subject and back to the camera. While strobe illumination is potentially disturbing to animate underwater subjects and increases the equipment that must be transported, it often offers the best available approach to photographing near subjects. However, since light must still travel twice the distance of the subject from the photographer, cyan overcast of intermediate distance subjects remains a problem. Notice that at a subject distance of only 1.5 meters (3.0 meters of light transmission distance) half of the red light emitted by the strobe is attenuated by the water before reaching the camera.

SUMMARY OF THE INVENTION

In one aspect the invention is directed to a color reversal photographic film particularly adapted for underwater photography comprised of a film support and, coated on the film support, three superimposed recording layer units consisting of a blue recording layer unit capable of forming a yellow dye image, a green recording layer unit capable of forming a magenta dye image, and a red recording layer unit capable of forming a cyan dye image, wherein at an exposure temperature of 5500° K. and an optical density of 0.8 above minimum density the red recording layer unit exhibits a speed that is (T/10) log E greater than that of the green recording layer unit, where E is exposure in lux-seconds and T is the light transmission distance in meters through water required to match the speed of the red recording layer unit to the speed of the green recording layer unit, T being in the range of from 1.5 to 15 meters.

The present invention offers a number of distinct advantages over the prior state of the art. First, it offers the capability of producing brilliant images of underwater subjects at near and intermediate distances. Unlike filter corrections of color balances underwater, the invention does not exact a speed (or granularity) penalty. Hence sharper images, greater depths of field and higher shutter speeds are feasible employing photographic elements satisfying the requirements of the invention as compared to employing daylight balanced photographic films in combination with underwater filters. The present invention is capable of eliminating the need for strobe illumination to record brilliant hues of near subjects and subjects at shallow depths. At intermediate subject distances and/or exposure depths the photographic elements are capable of providing images when employed in combination with strobe illumination that are chromatically superior (exhibit little or no cyan cast) as compared to images captured using conventional photographic films in combination with strobe illumination.

The present invention broadens the range of photographic opportunities for the underwater photographer to achieve images of brilliant hues, particularly red, orange and yellow hues. Further, the invention retains the desired cyan cast of distant subjects that is desired to place the image underwater in the viewers' consciousness. Finally, the invention provides the opportunity for achieving entirely new images of elusive and nonapproachable marine subjects.

DESCRIPTION OF PREFERRED EMBODIMENTS

The present invention is directed to a modified form of color reversal photographic films that improve their imaging capability when applied to underwater photography. The invention is applicable to color films intended for camera use that contain a film support and, coated on the film support, three superimposed recording layer units. The three superimposed recording layer units consist of a blue recording layer unit capable of forming a yellow dye image, a green recording layer unit capable of forming a magenta dye image, and a red recording layer unit capable of forming a cyan dye image.

In conventional color reversal photographic elements intended for daylight exposure the speeds of the blue and green recording layer units are substantially matched. For example, in a survey of nine commercially available color reversal films intended for daylight exposure the speeds of the blue recording layer units were observed to range from 0 to 0.08 log E faster than the speed of the green recording layer unit. The reason for the slight excess of blue speed is to mitigate color imbalances produced by blue deficient (e.g., tungsten filament) exposures, recognizing that photographers cannot or will not consistently follow the manufacturer's recommendation for daylight (5500° K.) exposure. In the preferred color reversal photographic elements of the invention the speed of the blue recording layer unit is substantially matched to that of the green recording layer unit within the tolerances found acceptable in conventional color reversal films. That is, blue speeds ranging from 0.05 log E slower than to 0.10 log E faster than the green speed are contemplated. However, relatively faster blue speeds can be employed to allow for tungsten filament or other blue-deficient illuminants.

In conventional color reversal photographic elements intended for daylight exposure the speeds of the green and red recording layer units are also substantially matched, but with the balance slightly favoring the green speed. For example, in a survey of the same nine commercially available color reversal films noted above intended for daylight exposure the speeds of the red recording layer units were observed to range from 0.10 to 0.01 log E slower than the speed of the green recording layer unit.

The color reversal photographic films of the invention are provided with an improved underwater imaging capability by increasing the speed of the red recording layer unit in relation to the speed of the green recording layer unit. To provide a specific point of reference, speeds of recording layer units are compared at an optical density of 0.8. Average contrasts for color reversal films are measured over the exposure range extending from an optical density of 0.8 to an optical density of 1.8. In every instance the optical density referenced is the optical density above minimum density (fog). For example, if the minimum density is 0.2, the reference density for speed determination is 0.8 above minimum density or 1.0.

In the photographic elements of this invention the red recording layer unit exhibits a speed that is (T/10) log E (exposure in lux-seconds) greater than that of the blue recording layer unit and T is the light transmission distance in meters through water required to match the speed of the red recording layer unit to the speed of the green recording layer unit, T being in the range of from 1.5 to 15 meters. The color photographic elements of this invention are those that increase the red speed in relation to the green speed sufficiently to compensate for the red light attenuation that occurs during the transmission of light through between 1.5 and 15 meters of water. This means that the red recording layer unit is at least one half stop (0.15 log E) faster than the green recording layer unit.

The upper limit of speed mismatch between the red recording layer unit and the green recording layer unit is dictated by taking other photographic parameters, such as cyan dye image granularity, into consideration. When a low granularity cyan dye image is desired, it is preferred that the red recording layer unit have a speed that is no more than three stops (0.9 log E) faster than that of the green recording layer unit. When the red recording layer unit is three stops faster than the green recording layer unit, a chromatically balanced image is produced when exposing radiation from a daylight (5500° K.) source has been transmitted through 9 meters of water. The exact relationship between red recording layer unit and green recording layer unit speeds for a specific application can be chosen by taking probable depth of imaging, subject distance and whether a strobe will or will not be used into account. Although the film is capable of recording the colors of an underwater subject to their exact appearance in daylight at only one underwater transmission distance, acceptable subject chromaticity can be realized over a range of underwater transmission distances. If the distance of underwater transmission of light is insufficient to reduce its red content to produce an image of desired color balance, as can occur at shallow depths, with close subjects and/or employing strobe illumination, it is possible to fit the camera or strobe with a red absorbing filter to bring the subject into better chromatic balance.

A technique that can be used to extend the range of underwater transmission distances over which acceptable subject chromaticity is observed is to decrease the contrast of the red recording layer unit in relation to that of the green recording layer unit. The contrast mismatch decreases preferentially the cyan cast of images at lower exposure levels (i.e., in darker image areas). Average contrasts of the red recording layer unit that exceed those of the green recording layer unit in the range of from 5 to 30 percent are preferred with a range from 10 to 20 percent being most preferred. Relatively reduced contrast red recording layer units are particularly useful in reducing the cyan cast of subjects at intermediate distances.

The most commonly employed recording layer unit arrangement of conventional photographic elements is the following:

| |
|---|
| Blue Recording Layer Unit |
| Green Recording Layer Unit |
| Red Recording Layer Unit |
| Support |
| Film Structure BGR |

Film Structure BGR is acceptable for the practice of the invention. The popularity of this layer unit arrangement is based on the location of the blue recording layer unit to receive exposing radiation prior to the remaining layer units. This allows a yellow filter layer (not shown) to be interposed between the blue and green recording layer units, thereby protecting the minus blue (green and red) recording layer units from blue exposure. This arrangement is particularly advantageous when the minus blue recording layer units have significant blue sensitivity, as is the case when the minus blue recording layer units are constructed using silver bromide and, particularly, silver bromoiodide photographic emulsions.

The green recording layer unit in Film Structure BGR is positioned to receive exposing radiation prior to the red recording layer unit, since the green exposure record is generally the most important source of visual information. However, in the practice of this invention it is advantageous to locate the red recording layer unit to receive exposing radiation prior to the green recording layer unit, as shown in the following film structure:

| |
|---|
| Blue Recording Layer Unit |
| Red Recording Layer Unit |
| Green Recording Layer Unit |
| Support |
| Film Structure BRG |

In the discussion above it was pointed out that the maximum acceptable increase in the speed of the red recording layer unit as compared to the speed of the blue recording layer unit is a function of other imaging parameters, most notably the maximum acceptable granularity of the cyan dye image. When Film Structures BGR and BRG are constructed to have identical blue speeds and the same increase in the red speed as compared to the blue speed, Film Structure BRG allows lower granularities to be realized in the red recording layer unit image. Alternatively viewed, Film Structure BRG allows larger increases in red recording layer unit speed to be obtained than in Film Structure I when the same levels of image granularity are in evidence in the red recording layer units of both Film Structures BGR and BRG. Film Structure BRG therefore represents a preferred film construction for underwater photography. Film Structure BRG still allows a yellow filter layer to be interposed between the blue and red recording layer units to protect the underlying minus blue recording layer units from exposure to blue light, if desired. This is generally preferred when employing silver bromide or silver bromoiodide emulsions in the minus blue recording layer units.

Because viewers are much less capable of judging underwater color balances as compared to those of everyday above water scenes, the recordation of residual blue light as well as red and green light by the minus blue recording layer units does not have nearly the same impact on the viewer. It is therefore possible to either reduce blue light filtration or to eliminate the yellow filter layer entirely when employing Film Structures BGR and BRG with silver bromide or bromoiodide emulsions while still achieving acceptable images.

In one specifically preferred form of the invention the red recording layer unit is located to receive exposing radiation prior to both the blue and green recording layer units. An arrangement of this type is illustrated by the following film structure:

| |
|---|
| Red Recording Layer Unit |
| Green Recording Layer Unit |
| Blue Recording Layer Unit |
| Support |
| Film Structure RGB |

In this arrangement the red recording layer unit is capable of exhibiting the highest levels of speed of with the minimum levels of granularity. Thus, speed differences between the red and remaining recording layer units can be increased further than in Structures BGR and BRG while still obtaining acceptable levels of granularity in the red recording layer unit. A further advantage of Film Structure RGB lies in placing the blue recording layer unit in the least favored imaging position. Since the eye draws only a small amount of its image information from the blue record and is relatively insensitive to the granularity of a yellow dye image, the practical effect of image quality reduction in the blue recording layer unit is much more than offset by the improvement in image quality in the red recording layer unit, which makes a disproportionately larger contribution to the viewer's perception of image quality.

Although historically the highest attainable photographic speeds have been obtained using silver bromoiodide emulsions, relatively recent investigations have confirmed that photographic speeds approaching those of silver bromoiodide emulsions are feasible employing high chloride (i.e., greater than 50 mole percent chloride, based on silver) silver halide emulsions. It is therefore contemplated to employ high chloride silver halide emulsions in each of Film Structures BGR, BRG and RGB. The use of high chloride silver halide emulsions is particularly advantageous in Film Structure RGB, since locating the blue recording layer unit to receive exposing radiation after the minus recording layer units precludes the use of a filter layer to prevent blue light from reaching the minus blue recording layer units. In addition to relying on silver chloride as the principal silver halide in constructing the recording layer units of Film Structure RGB it is also advantageous to limit the silver iodide content of the radiation sensitive grains present in at least the minus blue recording layer units of Film Structure RGB. High chloride silver halide emulsions containing 5 mole percent iodide based on silver are preferred, with less than 1 mole percent iodide based on silver being optimum. The presence of silver iodide can be used to increase photographic speed and enhance useful interimage effects in imaging, but has the disadvantage in the minus blue recording layer units of Film Structure RGB of increasing native blue sensitivity. Also iodide tends to reduce silver halide development rates.

Each of the blue, green and red recording layer units can contain a single conventional radiation sensitive silver halide emulsion layer. An improved relationship between photographic speed and granularity is realized when a plurality of emulsion layers differing in photographic speed are used for recording layer unit construction. For high quality images it is generally preferred to construct each recording layer unit of at least two emulsion layers. Three silver halide emulsion layers differing in photographic speed are specifically contemplated for the minus blue recording layer units. It is also recognized that all of the emulsion layers intended to record one portion of the spectrum (e.g., the blue, green or red portion of the spectrum) need not be coated together. Generally any conventional ordering of silver halide emulsion layers in color photographic elements can be applied to the practice of the invention. A variety of useful emulsions and emulsion layer arrangements useful in the practice of the invention are disclosed by Kofron et al U.S. Patent 4,439,520, the disclosure of which is here incorporated by reference.

The invention is generally applicable to color reversal imaging. Color reversal photographic elements are those that produce a positive dye image in the camera (taking) film. There is no intermediate printing step in obtaining a color reversal image. Therefore, the image hues that are recorded in the course of underwater photography are less susceptible to adjustment during processing. The present invention therefore can be applied to color reversal photographic elements with particular advantage.

The details of color photographic element construction, apart from the features described above, can take any convenient conventional form and require no detailed explanation to be understood by those skilled in the art. In addition to Kofron et al, cited above, details of film construction are illustrated by *Research Disclosure,* Vol. 308, December 1989, Item 308119, the disclosure of which is here incorporated by reference. Research Disclosure is published by Kenneth Mason Publications, Ltd., Emsworth, Hampshire P010 7DD, England.

The invention can be better appreciated by reference to the following specific illustrations. Reference "CC" filters refers to color correction filters. The number preceding the "CC" is 100 times the change in light exposure imparted by the filter—e.g., a 20 CC cyan filter reduces red exposure by 0.20 log E. Status A densities are ISO 5/3 standard densities. All densities are densities above minimum density.

I. Films with Fast Red Records

One method for correcting the cyan cast for a single distance of light travel is to place a complementary red filter over the camera lens; e.g. at a depth of 6 meters, an ideal 60 CC red filter would correct the color balance of objects very close to the camera. However, this would result in a 2-stop loss of film speed (0.60 log E), necessitating the use of a very high-speed film. A preferable approach is to use a film with a red record that is (in this example) 0.60 log E faster than the green and blue records. In this way, no green or blue speed is lost from camera lens filtration.

An example of this approach is documented below. The control film is a daylight-balanced ISO 100 speed film. The red, green, and blue speeds are similar (Table I), as required for proper color reproduction, when the film is exposed to a daylight illuminant (5500° K.). However, when the exposure is made through a filter pack simulating 6 meters of travel though water, the red speed is decreased by nearly 2 stops. (Due to unwanted absorption by real cyan filters, a filter pack of 110 CC cyan+20 CC yellow was used with +2 stops exposure compensation, which is approximately equivalent in effect to an ideal 60 CC cyan filter. Hereafter this filtration will simply be referred to as an ideal 60 CC cyan.) The invention differs from the control in having a red record from an ISO 400 speed film. When exposed to daylight filtered with an ideal 60 CC cyan, the inherent red speed of this emulsion compensates for the deficiency of red light in the exposure, and approximately matched red, green, and blue speeds result. Thus the invention is free of any undesirable cyan cast, without the film speed loss resulting from camera lens filtration.

TABLE I

Red, Green, and Blue Speeds
[-log 10 (lux-sec) at 0.8 Status A density above Dmin]
in Daylight and Underwater Illuminants

| | Daylight | | | 6 Meters Underwater | | |
|---|---|---|---|---|---|---|
| | Red | Green | Blue | Red | Green | Blue |
| Control | 0.81 | 0.80 | 0.80 | 0.30 | 0.83 | 0.90 |
| Invention | 1.28 | 0.91 | 0.80 | 0.90 | 0.93 | 0.94 |

Although this solution is somewhat analogous to high blue speed in tungsten-balanced film, the underwater illuminant is far more complicated than a tungsten illuminant, being dependent upon depth and subject distance. In addition, perceptual factors are involved, as a slight cyan cast is desirable to maintain the impression of an underwater environment, while correcting the color reproduction incompletely. To assess these tradeoffs, digital image simulations were made from scanned underwater photographs at known depths. The simulated images were assessed by divers and underwater photographers and the results were integrated with information about depths common in underwater photography to conclude that the preferred range of correction was 15–75 CC cyan (ideal), with 30–60 CC cyan (ideal) being particularly preferred.

II. Methods of Achieving Red Speed

The method of achieving high red film speed described in the previous section was to use an inherently more sensitive red emulsion in a conventional film structure, denoted BGR, for the record order from the emulsion surface to the film base. Another means of obtaining red speed is to place the red record at the top of the film pack (i.e. RGB or RBG), so that losses of red light due to absorption and reflection by the blue and green records is avoided. The advantage of this technique is that red emulsions of lower inherent speed, and consequently lower granularity, may be employed. Furthermore, red sharpness is improved considerably in this fashion because red light has not been scattered by overlying layers. A potential disadvantage of this method is that color reproduction and blue speed are degraded due to blue light absorption by the red (and, in RGB, the green) record. This may be minimized through the use of tabular emulsions in the red (and/or green) record, as they possess little intrinsic blue absorption.

Table II demonstrates the advantages of this approach. The control is the invention of Table I, structure BGR. The invention uses 100 speed red and green records, and a 400 speed blue record, coated in the structure RGB. The red, green, and blue speeds in daylight plus ideal 60 CC cyan are reasonably balanced for both the control and the invention. The visual root-mean-square (RMS) granularities (Status A density 1.0, X1000) and modulation transfer values at 20 line pairs per mm (1 pm) are also tabulated. Visual granularity is a predictor of image graininess, with a 5% decrease being a noticeable improvement. Visual modulation transfer is a predictor of image sharpness, with a 5% increase being a noticeable improvement under conditions relevant to the present case.

TABLE II

Speed, Grain, and Sharpness of Three Film Structures

| | Film Speed (See Table I) | | | 1000 X Visual RMS | Percent Visual Modulation Transfer |
|---|---|---|---|---|---|
| | Red | Green | Blue | Granularity | at 201 pm |
| Control (BGR) | 0.90 | 0.93 | 0.94 | 12.7 | 44 |
| Invention (RGB) | 1.04 | 0.98 | 1.07 | 10.9 | 56 |

terms of both graininess and sharpness, despite being slightly faster.

III. Correction via Contrast Mismatch

The fast red record approach discussed above corrects for cyan cast at a single distance of light travel through water. Photographic reproductions corrected in this manner alone will exhibit a cyan gradient with subject distance. For example, if a nearby subject is corrected to neutral, portions of the scene farther from the camera will appear progressively more cyan with increasing distance. It would therefore be desirable to introduce a mechanism that applies a greater amount of color correction to subjects at greater distances. In the case of strobe illumination, objects farther from the strobe receive less illumination than objects close to the strobe, according to the law of $X^{-2}$ falloff. Consequently, on average, subjects farther from the camera receive less light and so produce less exposure on the film, leading to higher densities in the final image. To correct for the cyan gradient in the scene, the cyan density in the final image should be reduced by a greater amount at higher densities (which correlate with greater distances). This may be accomplished by reducing cyan contrast in the film.

To demonstrate this effect, sensitometric exposures (daylight+ideal 60 CC cyan) were made of the RGB (control) and BGR (invention) structures described previously. The invention differs sensitometrically from the control primarily in having about 20% lower red contrast due to emulsion properties and laydown. The sensitometry was used to estimate the relative densities of midtone gray patches 1.5 and 3 meters from a strobe, assuming ambient exposure to be low and the patch at 1.5 meters to be rendered normally. This involved a 0.6 log E decrease in green and blue exposure, and a 0.9 log E change in red exposure (the latter number is 0.3 log E larger due to the 3 meters of additional travel through water for the patch at 3 meters). The density values are tabulated below. Ideally, the density shifts from the 1.5 meter exposure to the 3 meters exposure ideally should be equal in the red, green, and blue, implying similar color reproduction in the two patches. The control exhibits a significantly larger red density change than either green or blue density change between the two exposures, indicating that if a subject at 1.5 meters were rendered properly, then a subject at 3 meters would appear quite cyan in the reproduction. The invention exhibits much less discrepancy between red, green, and blue density differences than does the control, indicating a more consistent color reproduction with respect to subject distance.

TABLE III

Red, Green, and Blue Densities in Two Underwater Illuminants

| | Subject 1.5 Meters Away | | | Subject 3 Meters Away | | | Density Difference | | |
|---|---|---|---|---|---|---|---|---|---|
| | Red | Green | Blue | Red | Green | Blue | Red | Green | Blue |
| Control | 1.04 | 1.13 | 1.01 | 2.92 | 2.48 | 2.35 | 1.88 | 1.35 | 1.34 |
| Invention | 1.07 | 1.00 | 1.03 | 2.70 | 2.44 | 2.35 | 1.63 | 1.44 | 1.32 |

As described in the previous section, digitally simulated images were used to determine the optimal range of contrast reduction based on perceptual factors and artifacts resulting from nearby, dark scene elements that are over-corrected in color balance. The preferred range is 5-30% contrast reduction, with 10-20% being especially preferred.

IV. Strobe Systems

One technique used to avoid the cyan cast in photographs taken under water is the use of electronic strobe, but this approach is successful only if the subject is very close to the camera, so that the light travels through very little water between the strobe, subject, and camera lens. Portions of the scene more than a meter away are rendered cyan, due to both the distance light travels through the water, and the $X^{-2}$ falloff that causes strobe illumination to become dominated by cyan ambient illumination at greater distances. The fast red record films described earlier require that the strobe be filtered to partially or wholly compensate for the high red speed, since the strobe illumination is generally less cyan than ambient illumination (because it typically passes through less water). A film with a red record two stops faster than green and blue would require an ideal 60 CC cyan filter over the strobe for complete compensation, as already demonstrated in Section III-B. This might be regarded as a way of making the strobe illuminant more closely resemble in color the ambient illuminant, for which the film has been optimized.

It is also possible to fine-tune the balance by placing a filter over the camera lens and a complementary filter over the strobe; e.g. a 15 CC red filter over the lens coupled with a 15 CC cyan filter over the strobe increases the depth of optimum performance of the system. However, this is accompanied by a loss of one-half stop of film speed, and so is not a good method for effecting large balance changes.

The invention has been described in detail with particular reference to preferred embodiments thereof, but it will be understood that variations and modifications can be effected within the spirit and scope of the invention.

What is claimed is:

1. A color reversal photographic film particularly adapted for underwater photography comprised of a film support and, coated on the film support, three superimposed recording layer units consisting of a blue recording silver halide emulsion layer unit capable of forming a yellow dye image, a green recording silver halide emulsion layer unit capable of forming a magenta dye image, and a red recording silver halide emulsion layer unit capable of forming a cyan dye image, wherein at an exposure temperature of 5500° K. and an optical density of 0.8 above minimum density the red recording layer unit exhibits a speed that is (T/10) log E greater than that of the green recording layer unit, where E is exposure in lux-seconds and T is the light transmission distance in meters through water required to match the speed of the red recording layer unit to the speed of the blue recording layer unit, T being in the range of from 1.5 to 15 meters.

2. A color reversal photographic film particularly adapted for underwater photography according to claim 1 wherein the blue and green recording layer unit speeds are substantially matched.

3. A color reversal photographic film particularly adapted for underwater photography according to claim 1 wherein the speed of the blue recording layer unit exceeds that of the green recording layer unit.

4. A color reversal photographic film particularly adapted for underwater photography according to claim 1 wherein the red recording layer unit exhibits an average contrast over the optical density range of from 0.6 to 0.9 above minimum density that is in the range of from 5 to 30 percent less than that of the green recording layer unit.

5. A color reversal photographic film particularly adapted for underwater photography according to claim 4 wherein the red recording layer unit exhibits an average contrast that is in the range of from 10 to 20 percent less than that of the green recording layer unit.

6. A color reversal photographic film particularly adapted for underwater photography according to claim 1 wherein the red recording layer unit exhibits an average contrast over the optical density range of from 0.8 to 1.8 above minimum density that is in the range of from 5 to 30 percent less than that of the green recording layer unit.

7. A color reversal photographic film particularly adapted for underwater photography according to claim 6 wherein the red recording layer unit exhibits an average contrast that is in the range of from 10 to 20 percent less than that of the green recording layer unit.

8. A color reversal photographic film particularly adapted for underwater photography according to claim 1 wherein the red recording layer unit is located to receive exposing radiation prior to the blue and green recording layer units.

9. A color reversal photographic film particularly adapted for underwater photography according to claim 1 wherein at least the red recording layer unit contains a radiation-sensitive emulsion comprised of silver halide grains containing greater than 50 mole percent chloride and less than 5 mole percent iodide, based on total silver.

10. A color reversal photographic film particularly adapted for underwater photography comprised of a transparent film support and, coated on the film support, three superimposed recording layer units consisting of a blue recording silver halide emulsion layer unit capable of forming a yellow dye image, a green recording silver halide emulsion layer unit capable of forming a magenta dye image, and a red recording silver halide emulsion layer unit capable of forming a cyan dye image, wherein at an exposure temperature of 5500° K. and an optical density of 0.8 above minimum density the blue and green recording layer units are substantially matched in speed and the red recording layer unit exhibits a speed that is (T/10) log E greater than that of the blue recording layer unit, where E is exposure in lux-seconds and T is the light transmission distance in meters through water required to match the speed of the red recording layer unit to the speed of the green recording layer unit, T being in the range of from 1.5 to 9 meters, and the red recording layer unit exhibits an average contrast over the optical density range of from 0.8 to 1.8 above minimum density that is in the range of from 10 to 30 percent less than that of the green recording layer unit.

11. A color reversal photographic film particularly adapted for underwater photography according to claim 10 wherein, of the three recording layer units, the blue recording layer unit is coated nearest the support and the red recording layer unit is coated farthest from the support, the granularity of the green and red recording layer units is less than that of the blue recording layer unit, and at least the green and red recording layer units are comprised of radiation emulsions comprised of silver halide grains comprised of greater than 50 mole percent chloride and less than 1 mole percent iodide, based on total silver.

* * * * *